US009297245B2

(12) United States Patent
Stephenson et al.

(10) Patent No.: US 9,297,245 B2
(45) Date of Patent: Mar. 29, 2016

(54) SYSTEM AND METHOD FOR CHANGING PROPPANT CONCENTRATION

(71) Applicant: Halliburton Energy Services, Inc., Houston, TX (US)

(72) Inventors: Stanley V. Stephenson, Duncan, OK (US); Wesley J. Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/366,140

(22) PCT Filed: Aug. 15, 2013

(86) PCT No.: PCT/US2013/055172

§ 371 (c)(1),
(2) Date: Jun. 17, 2014

(87) PCT Pub. No.: WO2015/023283

PCT Pub. Date: Feb. 19, 2015

(65) Prior Publication Data

US 2015/0083400 A1 Mar. 26, 2015

(51) Int. Cl.
*F04B 49/00* (2006.01)
*E21B 43/267* (2006.01)
(Continued)

(52) U.S. Cl.
CPC ..... *E21B 43/267* (2013.01); *E21B 41/0092* (2013.01); *F04B 49/00* (2013.01); *F04B 53/162* (2013.01); *F04B 23/06* (2013.01)

(58) Field of Classification Search
CPC . F04D 27/0261; F04D 15/00; F04D 15/0066; F04D 15/0092; F04D 2207/043; F04D 2207/041; F04B 49/00; F04B 49/20; F04B 53/162; F04B 2207/041; F04B 23/04; F04B 23/06; F04B 13/02; E21B 43/26; E21B 43/267; E21B 41/0092
USPC ..... 73/861, 861.04; 702/45; 417/2, 3, 4, 20, 417/43
See application file for complete search history.

(56) References Cited

U.S. PATENT DOCUMENTS 3,744,932 A * 7/1973 Prevett ..... 417/8
4,538,221 A * 8/1985 Crain et al. ..... 700/67
(Continued)

FOREIGN PATENT DOCUMENTS

EP 0695852 A2 2/1996
WO 2007040837 A1 4/2007
WO 2015023283 A1 2/2015

OTHER PUBLICATIONS

International Search Report and Written Opinion for PCT/US/2013/055172 dated May 15, 2014.

*Primary Examiner* — Devon Kramer
*Assistant Examiner* — Nathan Zollinger
(74) *Attorney, Agent, or Firm* — McDermott Will & Emery LLP; John W. Wustenberg

(57) ABSTRACT

Disclosed are systems and methods utilizing multiple parallel pumps to deliver a mixture of the proppant and clean fluid via a manifold trailer. One method of providing a step-change in proppant concentration includes selecting a first flow rate for a first pump connected between a first input node and first output node, calculating a first transit time for a flow of a fluid at the first flow rate through a first flow path extending from the first inlet node, through the first pump, and to the first outlet node, and calculating a second flow rate for a second pump connected between the first input node and the first output node such that a second transit time for a flow of the fluid through a second flow path extending from the first inlet node, through the second pump, and to the first outlet node is equal to the first transit time.

16 Claims, 5 Drawing Sheets

(51) Int. Cl.

| | |
|---|---|
| ***E21B 41/00*** | (2006.01) |
| ***F04B 53/16*** | (2006.01) |
| *F04B 23/06* | (2006.01) |

(56) References Cited

U.S. PATENT DOCUMENTS

| | | | | | |
|---|---|---|---|---|---|
| 4,706,885 | A * | 11/1987 | Morin | 239/76 | |
| 5,360,320 | A * | 11/1994 | Jameson | G05D 11/131 | 210/101 |
| 5,799,734 | A * | 9/1998 | Norman et al. | 166/278 | |
| 6,904,982 | B2 | 6/2005 | Judge et al. | | |
| 7,090,017 | B2 * | 8/2006 | Justus et al. | 166/308.1 | |
| 7,998,434 | B2 * | 8/2011 | Shaw | G01N 1/38 | 250/288 |
| 8,347,957 | B2 | 1/2013 | Stephenson et al. | | |
| 8,388,598 | B2 * | 3/2013 | Steinkogler | 604/503 | |
| 8,960,293 | B2 * | 2/2015 | Medvedev et al. | 166/308.1 | |
| 2010/0059226 | A1 | 3/2010 | Termine et al. | | |
| 2010/0252262 | A1 | 10/2010 | Ekstrand et al. | | |
| 2010/0282464 | A1 * | 11/2010 | Medvedev et al. | 166/280.1 | |
| 2013/0218080 | A1 * | 8/2013 | Peterfreund et al. | 604/151 | |

* cited by examiner

SYSTEM AND METHOD FOR CHANGING PROPPANT CONCENTRATION

BACKGROUND

The present disclosure relates generally to systems and methods for quickly changing the concentration of a proppant carried in a clean fluid and, more particularly, to manifold trailers configured to utilize multiple parallel pumps to deliver a mixture of the proppant and clean fluid.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing the casing or liner into place. Once the well bore is completed as desired (lined, cased, open hole, or any other known completion), a stimulation operation may be performed to enhance hydrocarbon production into the well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

In some applications, it may be desirable to individually and selectively create multiple fractures at a predetermined distance from each other along a wellbore by creating multiple "pay zones." In order to maximize production, these multiple fractures should have adequate conductivity. The creation of multiple pay zones is particularly advantageous when stimulating a formation from a wellbore or completing a wellbore, specifically, those wellbores that are highly deviated or horizontal. The creation of such multiple pay zones may be accomplished using a variety of tools that may include a movable fracturing tool with perforating and fracturing capabilities or actuatable sleeve assemblies disposed in a downhole tubular such as disclosed in U.S. Pat. No. 5,765,642.

One typical formation stimulation process may involve hydraulic fracturing of the formation and placement of a proppant in those fractures. Typically, a fracturing fluid (comprising a clean fluid and the proppant) is mixed at the surface before being pumped downhole in order to induce fractures in the formation of interest. The creation of such fractures will increase the production of hydrocarbons by increasing the flow paths in to the wellbore.

Oftentimes well operators attempt to "pillar frack" the formation, which involves introducing pulses or plugs of proppant into the clean fluid cyclically, thereby providing the target production zone with a step-changed fracturing fluid. In theory, the step-changed fracturing fluid creates strategically placed proppant pillars within the fractured formation, thereby enhancing conductivity. Ideally, the transition from the clean fluid to a mixture of clean fluid and proppant is an abrupt or sharp step-change. However, conventional methods of mixing the proppant and clean fluid often result in a spreading of the transition between the clean fluid and the proppant, thereby leading to a gradual transition rather than the desired step-change.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
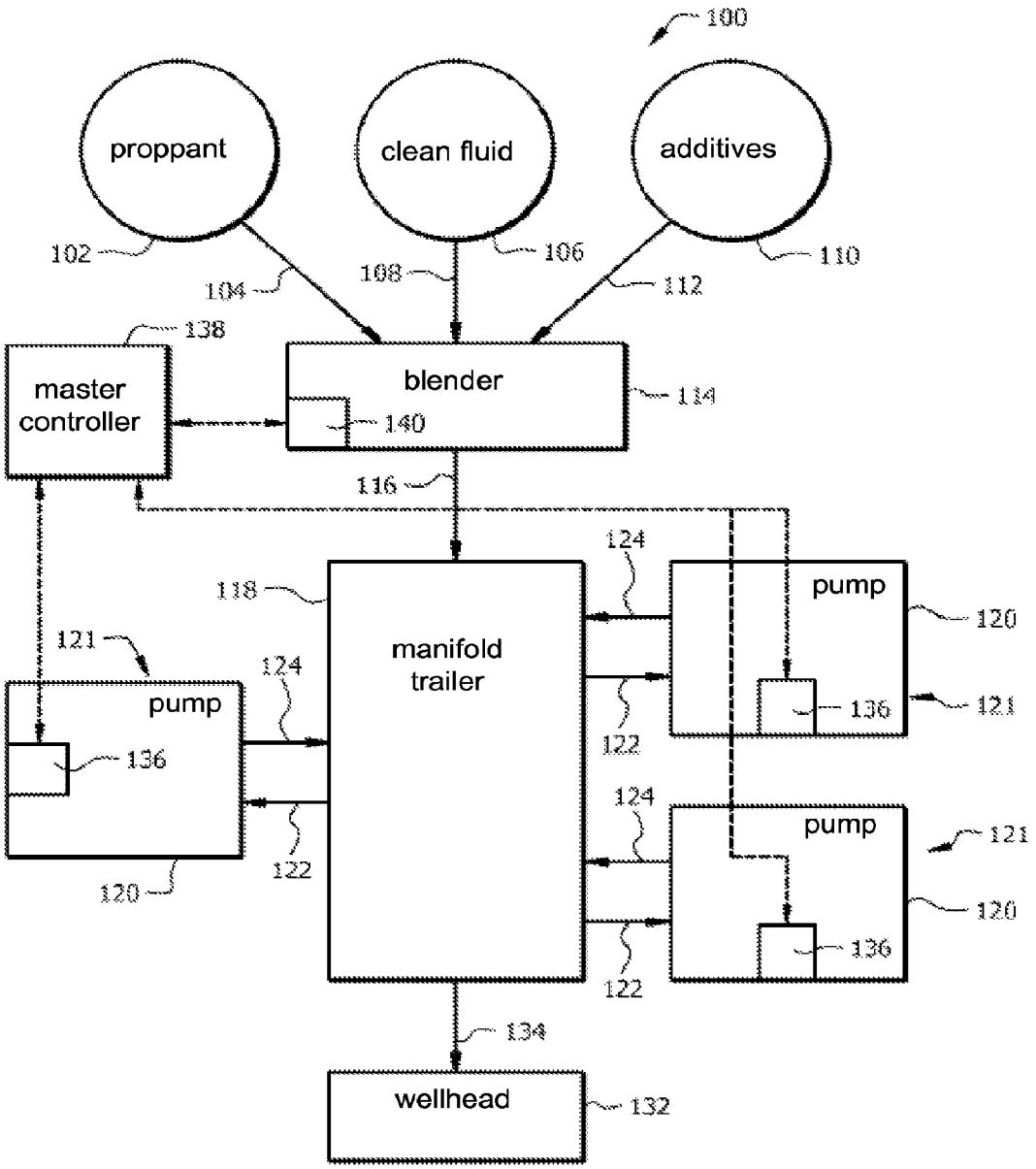
FIG. 1 is a simplified schematic view of a wellbore servicing system, according to one or more embodiments.

The present disclosure relates generally to systems and methods for quickly changing the concentration of a proppant carried in a clean fluid and, more particularly, to manifold trailers configured to utilize multiple parallel pumps to deliver a mixture of the proppant and clean fluid.

The disclosed embodiments are directed to a manifold trailer having multiple pumps arranged in parallel between a common inlet and a common outlet. The input flow of a fluid at the inlet may have a step-change in a characteristic of the fluid, for example, a proppant concentration, and it is advantageous to provide this same step-change in the characteristic in the output flow. Sharp or abrupt step-changes can result in effective pillar fracturing of a subterranean formation.

While the disclosed methods and apparatus are discussed in terms of manifold trailer for use in an oil and/or gas well, the same principles and concepts may be equally employed for delivering square-wave pulses of varying composition using parallel pumps. For example, the methods and apparatus of the present disclosure may equally be applied to other fields or technologies that involve or require pumping.

As used herein, the term "proppant" or variations thereof refers to mixtures comprising one of more granular solids such as sized sand, resin-coated sand, sintered bauxite beads, metal beads or balls, ceramic particles, glass beads, polymer resin beads, or bio-degradable materials such ground nut shells, and the like. In certain embodiments, the proportion of biodegradable proppant may be in the range of 5-90%, as designed by the user of the process.

As used herein, the phrase "proppant slurry" or variations thereof refers to a proppant-carrying fluid that is a mixture of a granular solid, such as sand, with a liquid, such as water or a gel. The proppant slurry may be any mixture capable of suspending and transporting proppant in concentrations above about 25 pounds of proppant per gallon of proppant slurry. In certain embodiments, the proppant slurry may contain up to 27 pounds of granular solid per gallon of fluid. In certain embodiments, the proppant slurry may also include other substances such as viscosity modifiers, thickeners, etc. In one exemplary embodiment, the proppant slurry may be LIQUIDSAND™ commercially available from Halliburton Energy Services, Inc., of Houston, Tex. and disclosed in U.S. Pat. No. 5,799,734.

In certain embodiments, the proppant slurry may comprise any water-containing fluid that does not adversely react with the subterranean formation or the other fluid constituents. For example, the fluid can comprise an aqueous mineral or organic acid, an aqueous salt solution such as potassium chloride solution, ammonium chloride solution, an aqueous organic quaternary ammonium chloride solution, or the like.

In certain embodiments, the proppant slurry may comprise a gelling agent that may comprise substantially any of the viscosifying compounds known to function in the desired manner. The gelling agent can comprise, for example, substantially any polysaccharide polymer viscosifying agent such as guar gum, derivatized guars such as hydroxypropylguar, derivatized cellulosics such as hydroxyethylcellulose, derivatives of starch, polyvinyl alcohols, acrylarnides, xanthan gums, and the like. A specific example of a suitable gelling agent is guar, hydroxypropylguar, or carboxymethyl hydroxypropylguar present in an amount of from about 0.2 to about 0.75 weight percent in the fluid.

As used herein, the phrase "clean fluid," or variations thereof, refers to a fluid that does not have significant amounts of proppant or other solid materials suspended therein. Clean fluids may include most brines, including fresh water. The brines may sometimes contain viscosifying agents or friction reducers. The clean fluid may also be energized fluids such as foamed or comingled brines with carbon dioxide or nitrogen, acid mixtures or oil, based fluids and emulsion fluids.

As used herein, the phrase "fracturing fluid," or variations thereof, refers to a mixture of a clean fluid and a proppant or proppant slurry in any proportion.

Within this document, a reference identifier may be used as a general label, for example "101," for a type of element and alternately used to indicate a specific instance or characterization, for example "101A" and 101B," for the same type of element.

Referring to FIG. 1, a wellbore servicing system 100 is shown. The wellbore servicing system 100 is configured for fracturing wells in low-permeability reservoirs, among other wellbore servicing jobs. In fracturing operations, wellbore servicing fluids, such as particle-laden fluids, are pumped at high pressure downhole into a wellbore. In this embodiment, the wellbore servicing system 100 introduces particle laden fluids into a portion of a subterranean hydrocarbon formation at a sufficient pressure and velocity to cut a casing, create perforation tunnels, and/or form and extend fractures within the subterranean hydrocarbon formation. Proppants, such as grains of sand, are mixed with the wellbore servicing fluid to keep the fractures open so that hydrocarbons may be produced from the subterranean hydrocarbon formation and flow into the wellbore. This hydraulic fracturing creates high-conductivity fluid communication between the wellbore and the subterranean hydrocarbon formation.

As illustrated, the wellbore servicing system 100 may include a blender 114 that is coupled to a wellbore services manifold trailer 118 via one or more flowlines 116. As used herein, the term "wellbore services manifold trailer" is meant to collectively include a truck and/or trailer comprising one or more pump manifolds for receiving, organizing, and/or distributing wellbore servicing fluids during wellbore servicing operations. In the illustrated embodiment, the wellbore services manifold trailer 118 is coupled to three positive displacement pumps 120 via outlet flowlines 122 and inlet flowlines 124. Outlet flowlines 122 supply fluid to the pumps 120 from the wellbore services manifold trailer 118. Inlet flowlines 124 supply fluid to the wellbore services manifold trailer 118 from the pumps 120.

Together, the three positive displacement pumps 120 form a pump group 121. In alternative embodiments, however, there may be more or fewer positive displacement pumps used in a wellbore servicing operation and/or the pumps may be other than positive displacement pumps. The wellbore services manifold trailer 118 generally has manifold outlets from which wellbore servicing fluids flow to a wellhead 132 via one or more flowlines 134.

Each pump 120 is further equipped with a pump monitor 136 that monitors various operational characteristics of the pumps 120 to which the pump monitors 136 are associated. More specifically, the pump monitors 136 comprise any sensors necessary to monitor, record, report, communicate, display, and/or log the various operational characteristics of the pumps 120 as described below in more detail.

Figure 2:
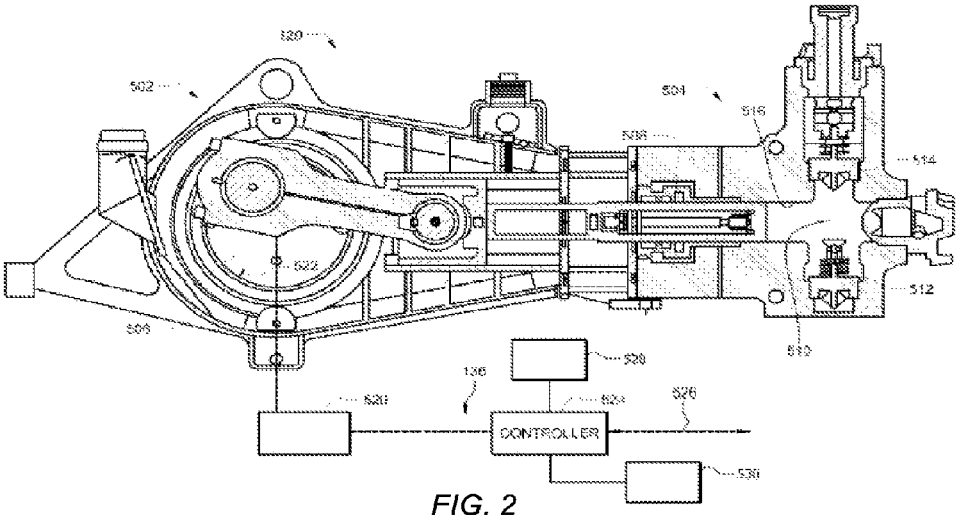
FIG. 2 is a cut-away view of a pump according to the system of FIG. 1, according to one or more embodiments.

Referring now to FIG. 2, a pump 120 is shown in greater detail. In this embodiment, the pump 120 is a HT-400™ Triplex positive displacement pump, produced by Halliburton Energy Services, Inc. The pump 120 includes a power end 502 and a fluid end 504 attached to the power end 502. The power end 502 comprises a crankshaft 506 that reciprocates a plunger 508 within a bore 516 of the fluid end 504. The fluid end 504 further comprises a compression chamber 510 into which fluid flows through a suction valve 512. Fluid is pumped out of the compression chamber 510 through a discharge valve 514 as the plunger 508 is moved toward the compression chamber 510.

A sensor 520 of the pump monitor 136 uses a timing marker 522 that is associated with the crankshaft 506 to monitor the number of rotations of the crankshaft 506. The pump monitor 136 further comprises a multi-purpose sensor 528 for sensing the necessary operational characteristics of the pump 120 and/or wellbore treating fluid, including output pressure, hours at pressure bands, hours at power bands, horsepower hours, hours of pump operation per drive gear, and combinations thereof. A controller 524 receives signals from the sensors 520, 528 and is configured to monitor, record, report, communicate, display, and/or log the information provided to the controller 524 by the sensors 520, 528. Of course, the controller 524 may be connected to other systems, computers, monitors, controllers, and/or other suitable equipment for monitoring the pump 120.

It will further be appreciated that communication between the controller 524 and other systems may be bi-directional and may take place over a bi-directional communications link 526. Of course, in alternative embodiments, the pump monitor 136 may be self-contained, may communicate in a unidirectional manner, and may comprise other systems or components for monitoring, recording, reporting, communicating, displaying, and/or logging the information provided to the controller 524 by the sensors 520, 528. In this embodiment, a display 530 is in communication with the controller 524 and may selectively display any of the above monitored operational characteristics of the pump 120 and/or a remaining life estimate and/or a probability of survival estimate of the pump 120.

Referring back to FIG. 1, the blender 114 mixes solid and fluid components to achieve a well-blended wellbore servicing fluid. As depicted, one or more of a proppant 102, a clean fluid 106, and additives 110 may be fed into the blender 114 via feedlines 104, 108, and 112, respectively. The clean fluid 106 may be potable water, non-potable water, untreated water, treated water, hydrocarbon based or other fluids. The mixing conditions of the blender 114, including time period, agitation method, pressure, and temperature of the blender 114, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering the wellbore services manifold trailer 118.

A blender monitor 140 monitors various operational characteristics of the blender 114 in substantially the same manner that the pump monitor 136 acts to monitor operation characteristics of the pump 120. The pump monitors 136 and the blender monitor 140 may each provide information to a master controller 138 that is in communication with the pump monitors 136 and a blender monitor 140. The blender monitor 140 is also capable of selectively displaying any monitored operational characteristic of the blender 114 and/or a remaining life estimate and/or a probability of survival estimate of the blender 114.

Figure 3:
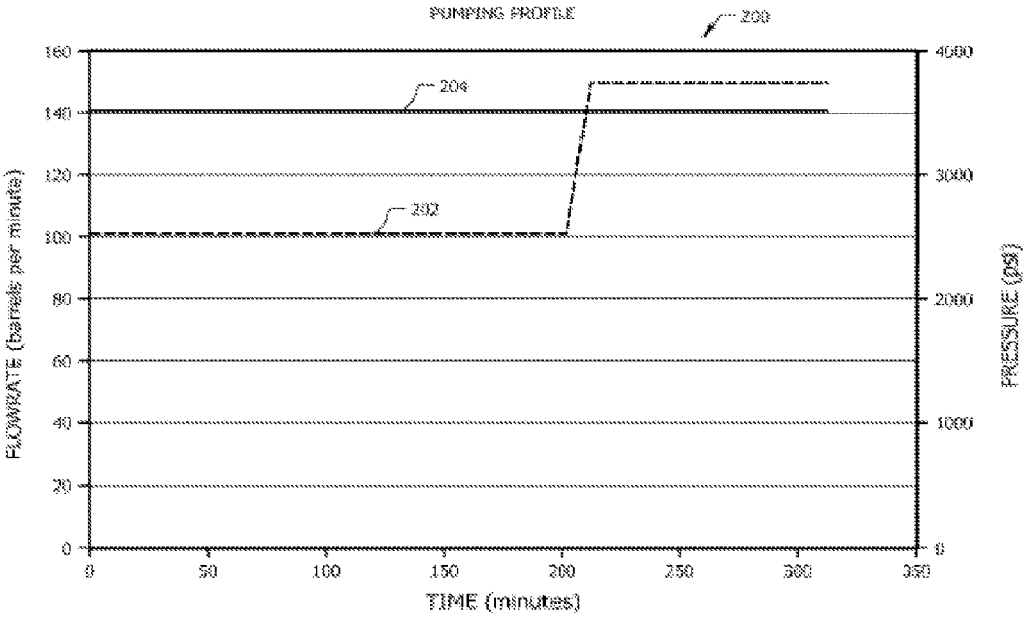
FIG. 3 is a graph of a performance plan according to a pumping profile of the wellbore servicing system of FIG. 1, according to one or more embodiments.

Referring now to FIG. 3, with continued reference to FIG. 1, the wellbore servicing system 100 is operable to deliver wellbore servicing fluids to the wellhead 132 according to an established pumping profile 200. A "pumping profile" refers to a performance plan for an operational characteristic of a wellbore servicing system. It will be appreciated that a single pumping profile may comprise one or more performance plans and that a wellbore servicing system may operate according to one or more pumping profiles, either simultaneously or consecutively. It will further be appreciated that a single pumping profile may comprise one or more performance plans for a single operational characteristic. In other words, a pumping profile may comprise one or more performance plans for one or more operational characteristics of a wellbore servicing system and a wellbore servicing system may operate according to one or more pumping profiles.

Still referring to FIG. 3, the illustrated pumping profile 200 comprises a performance plan for the flow rate, shown as curve 202, and a performance plan for the output pressure, shown as curve 204, to be provided by the pump group 121 (FIG. 1) over a period of time. As shown, pump group 121 is tasked with delivering wellbore servicing fluids downhole at a rate of about 100 barrels per minute for about the first 200 minutes of operation. After the first 200 minutes of operation, the desired flowrate 202 is increased over approximately 10 minutes to a new desired flowrate of approximately 150 barrels per minute. After reaching the flowrate of approximately 150 barrels per minute, the pump group 121 is tasked with continuing to deliver about 150 barrels per minute until about minute-320 of operation.

At the same time, the pump group 121 is tasked with delivering wellbore servicing fluids downhole at a pressure of about 3500 psi over the entire about 320 minutes of operation, as shown by curve 204. It will be appreciated that in other embodiments and in this embodiment when operated according to alternative pumping profiles, the pump group 121 may be tasked with delivering wellbore servicing fluids downhole at various other pressures and flow rates over the course of operation of the pump group 121. The pumping profile 200 is an example of a pumping profile that comprises a plurality of performance plans since pumping profile 200 comprises both the performance plan 202 for a combined pump group flow rate and the performance plan 204 for the combined pump group pressure.

Figure 4:
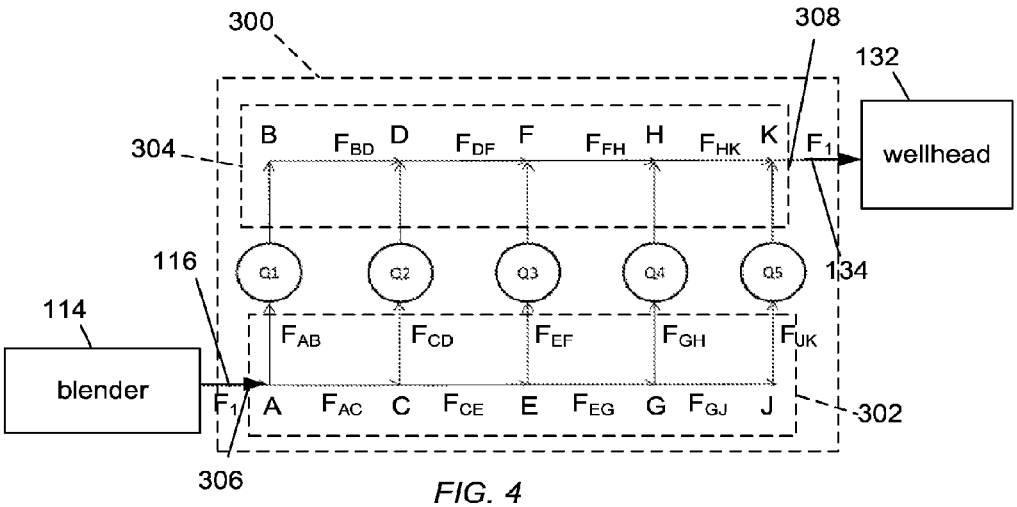
FIG. 4 PRIOR ART
FIG. 4 is a schematic diagram of a conventional manifold and pump system.

FIG. 4 is a schematic of a conventional manifold trailer 300. In this example, there are five positive-displacement pumps Q1-Q5 that are fluidly connected between an intake manifold 302 and an output manifold 304. The intake manifold 302 has a single inlet 306 connected to the flowline 116 of FIG. 1 coming from the blender 114, and the output manifold 304 has a single outlet 308 connected to the flowline 134 of FIG. 1 passing to the wellhead 132. The junctions where the flow through a single pipe splits into two flows through two pipes, and where flows through two pipes combine into a single flow through a single pipe, are marked with letters "A" through "K," not including the letter "I" to avoid confusion. The flow rate in each pipe segment is denoted by the variable $F_{XY}$, wherein the subscript "X" is the source junction and the subscript "Y" is the destination junction. For example, $F_{AC}$ represents the flow rate from junction A to junction C. Once start-up is completed, the flow rate into the inlet 306 and from the outlet 308 must be the same and are denoted by the variable $F_1$.

Each pipe segment between junctions, and between junctions and the individual pumps Q1-A5, may have a different length and/or a different diameter. The volume of each pipe segment is at least one parameter of interest and is denoted by the variable $V_{XY}$, using the same "X" and "Y" subscripts as apply to the flow rate $F_{XY}$ such that $V_{XY}$ and $F_{XY}$ refer to the volume and flow rate within the same pipe segment.

In operation, the fluid entering the inlet 306 from the blender 114 may have a step change in the proppant concentration. As the flow $F_1$ is split to pass through two or more of the pumps Q1-Q5 and thereafter re-joined, the integrity of the step-change in the flow from the outlet 308 is dependent upon the transit times through each separate path through the manifold trailer 300. For example, a first path from the inlet 306 to the outlet 308 may be 306-A-B-D-F-H-K-308 while a second exemplary path from the inlet 306 to the outlet 308 may be 306-A-C-E-G-H-K-308. Since the initial segment 306-A and the final segment K-208 are common to both paths, it will be appreciated that the remaining intermediate paths create various differences in the path characteristics.

If the transit time through all paths is identical, then the step-change at the inlet will be transferred essentially intact to the outlet 308. In practice, however, the lengths and diameters of the pipe segments, which may be provided as flexible hoses, vary between some or all of the pipe segments. This leads to different transit times along each path that, in turn, causes the step change that is propagating through multiple paths to arrive at the outlet 308 at different times, which broadens the change in proppant concentration in the flow from outlet 208, i.e., degrades the step change.

The following equations are related to the first and second exemplary paths identified above, i.e., 306-A-B-D-F-H-K-308 and 306-A-C-E-G-H-K-308. In general, the pumps Q1-Q5 may be identical pumps that are operated at a common pumping speed, and this is the configuration analyzed below for the configuration of FIG. 4. The transit time of each pipe segment is denoted by the variable $T_{XY}$, using the same "X" and "Y" subscripts as applied to the respective pipe segment, and $T_1$ denotes the transit time for path 1, excluding the common path elements 306-A and K-308.

$$T_1=T_{AQ1}+T_{Q1B}+T_{BD}+T_{DF}+T_{FH}+T_{HK}$$

$$T_2=T_{AC}+T_{CE}+T_{EG}+T_{GJ}+T_{JQ5}\pm T_{Q5K}$$

$$T_1=V_1/F_1 \text{ (volume of path 1/flow rate of path 1)}$$

$$T_2=V_2/F_2 \text{ (volume of path 2/flow rate of path 2)}$$

$F_1=F_2=F$ (pumps $Q1$, $Q5$ are identical, at common speed)

As such, the ratio of the arrival times along the two paths is:

$$T_1/T_2=V_1/V_2$$

The volumes of the two paths are:

$$V_1=V_{AQ1}+V_{Q1B}+V_{BD}+V_{DF}+V_{FH}+V_{HK}$$

$$V_2=V_{AC}+V_{CE}+V_{EG}+V_{GJ}+V_{JQ5}+V_{Q5K}$$

If, for this example, the pipe segments connected to the pumps Q1 and Q5 are all identical and equal to V and all of the pipe segments between nodes are identical and equal to V except for the pipe segments BD and FH that have a volume 2V, i.e., twice as large as the other pipe segments, then the ratio of times is:

$$T_1/T_2=(V+V+2V+V+V+2V)/(V+V+V+V+V+V)$$

$$T_1/T_2=8V/6V=1.33$$

Thus, for this very simplified example, it can be seen that changing the characteristics of two pipe segments, for example by using flexible hoses that are twice as long as the other hoses, can produce a significant variance in the transit times along various flow paths through the manifold trailer 300. If one were to consider all five flow paths and a more realistic characterization wherein each pipe segment has a different volume and each pump Q1-Q5 provides a different flow rate, it would be apparent that a step change in proppant concentration in the flow entering the inlet 306 may be seriously degraded during transit through the various flow paths of the manifold trailer 300. This effect is discussed in greater detail with respect to FIGS. 6 and 8.

Figure 5:
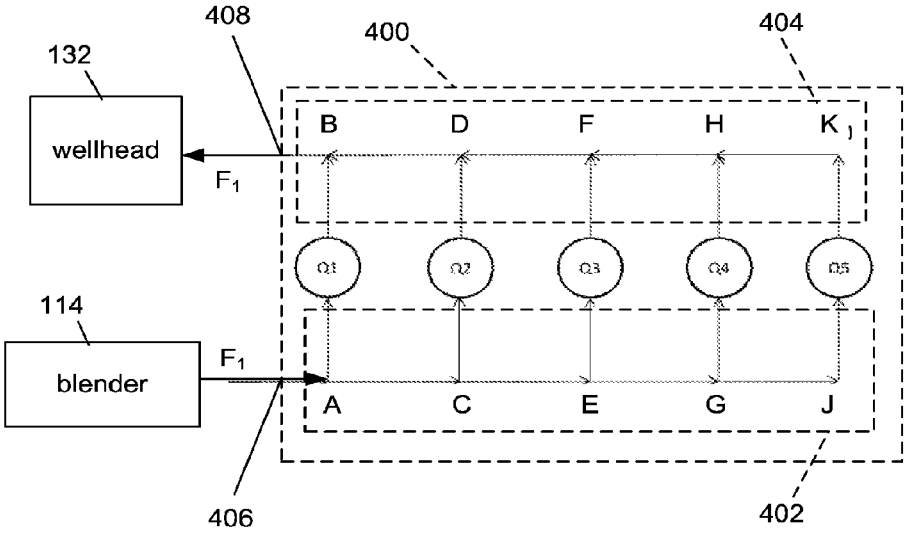
FIG. 5 is a schematic diagram of a manifold and pump system configured to provide step changes in proppant concentration, according to one or more embodiments.

FIG. 5 is a schematic of a manifold trailer 400 configured to provide step changes in proppant concentration, according to one or more embodiments. In this example, there are five positive-displacement pumps Q1-Q5 that are connected between an intake manifold 402 having an inlet 406 and an output manifold 404 having an outlet 408. Node identifiers have been assigned similar to those in FIG. 4 and the arrangement of pipe segments between the nodes in FIG. 5 is similar in many respects to the arrangement in FIG. 4. As will be seen, the relocation of the outlet 408 to the end of the output manifold 404 that is proximate to pump Q1, as compared to the proximity of outlet 308 to pump Q5 in FIG. 4, provides certain advantages described below.

In the manifold trailer 400, the transit times of each path through the various pumps Q1-Q5 may be independently adjusted by varying the operational speed of the individual pumps Q1-Q5. The transit time of flow path G-J-Q5-K-H may be initially calculated for an arbitrary flow rate from Q5. The flow rate for pump Q4 may then be calculated such that the transit time of path G-Q4-H matches the transit time of G-J-Q5-K-H. Once this is done, the transit times for the paths E-G-J-Q5-K-H-F and E-G-Q4-H-F should be the same and the flow rate for pump Q3 may then be calculated such that the transit time of path E-Q3-F matches the prior two paths. This process can be repeated for pumps Q2 and then Q1.

The various pump speeds of Q1-Q5 create a common transit time through all flow paths between the inlet 406 and the outlet 408, but the summed flow rate of the pumps Q1-Q5 operating at the determined flow rates may not be the desired flow rate. The flow rate of each pump Q1-Q5 may be adjusted by a ratio of the desired total flow rate to the summed flow rate, thereby making the summed flow rate equal to the desired flow rate while maintaining the relationship of the flow rates of pumps Q1-Q4 to pump Q5. This will result in retaining a common transit time for all flow paths. Moreover, this may provide a clean transfer of a step-change in proppant concentration from the inlet 406 to the outlet 408. It is evident to one skilled in the art that a common transit time can be obtained by configuring all flow paths A-Q1-B, A-C-Q2-D-B, A-C-E-Q3-F-D-B, A-C-E-G-Q4-H-F-D-B AND A-C-E-G-J-Q5 K H F D B to have the same volume. With the same volume for each flow path, the pumps Q1-Q5 could be run at the same flow rate. Likewise, the flow path volumes in the manifold trailer could be adjusted such that the pumps Q1-Q5 could be run at any desired flow rate ratio to each other.

To facilitate a better understanding of the present disclosure, the following examples of preferred or representative embodiments are given. In no way should the following examples be read to limit, or to define, the scope of the disclosure.

EXAMPLES

Desired total flow rate=25 barrels per minute (bpm); all pumps Q1-Q5 of FIG. 5 to be used; volume of all pipe segments connected to a pump, $V_P$=0.3 barrels; volume of all pipe segments connected between nodes, $V_N$=0.5 barrels.

The pump speed of pump Q5 is arbitrarily picked to be half of the desired total flow rate:

$$Q5=25/2=12.5 \text{ bpm}$$

The volume of the pipe segments carrying only the flow of pump Q5 is:

$$V_{GH(5)}=V_{GJ}+V_{JQ5}+V_{Q5K}+V_{KH}$$

Therefore, the transit time between nodes G and H through pump Q5, after substituting the assumed volumes listed above, is:

$$T_{GH}=V_{GH(5)}/Q5$$

$$T_{GH}=(V_{GJ}+VJ_{Q5}+V_{Q5K}+V_{KH})/Q5=(0.5+0.3+0.3+0.5)/Q5$$

$$T_{GH}=1.6/12.5=0.128 \text{ minutes}$$

Moving to pump Q4, connected between the same nodes G and H:

$$T_{GH(4)}=V_{GQ4}+V_{Q4H}=0.3+0.3=0.6$$

$$Q_4=V_{GH(4)}/T_{GH}=0.6/0.128=4.69 \text{ bpm}$$

For pump Q3, the transit time between nodes E and F must first be calculated for pump Q5:

$$T_{EF}=(V_{EG}+V_{GJ}+V_{JQ5}+V_{Q5K}+V_{KH}+V_{HF})/Q5$$

$$T_{EF}=(2.6)/12.5=0.208 \text{ minutes}$$

then the flow rate Q3 to match this transit time between nodes E and F can be calculated:

$$V_{EF(3)}=V_{EQ3}+V_{Q3F}=0.3+0.3=0.6$$

$$Q_3=V_{EF(3)}/T_{EF}=0.6/0.208=2.88 \text{ bpm}$$

For pump Q2, the transit time between nodes C and D must be calculated for pump Q5:

$$T_{CD}=(V_{CE}+V_{EG}+V_{GJ}+V_{JQ5}+V_{Q5K}+V_{KH}+V_{HF}+V_{FD})/Q5$$

$$T_{CD}=(3.6)/12.5=0.288 \text{ minutes}$$

then the flow rate Q2 to match this transit time between nodes C and D can be calculated:

$$V_{CD(2)}=V_{CQ2}+V_{Q2D}=0.3+0.3=0.6$$

$$Q_2=V_{CD(2)}/T_{CD}=0.6/0.288=2.08 \text{ bpm}$$

For pump Q1, the transit time between nodes A and B must be calculated for pump Q5:

$$T_{AB}=(V_{AC}+V_{CE}+V_{EG}+V_{GJ}+V_{JQ5}+V_{Q5K}+V_{KH}+V_{HF}+V_{FD}+V_{DB})/Q5$$

$$T_{AB}=(4.6)/12.5=0.368 \text{ minutes}$$

then the flow rate Q1 to match this transit time between nodes A and B can be calculated:

$$V_{AB(1)}=V_{AQ1}+V_{Q1B}=0.3+0.3=0.6$$

$$Q_1=V_{AB(1)}/T_{AB}=0.6/0.288=1.63 \text{ bpm}$$

Thus, the calculated flow rates of the five pumps Q1-Q5 are: Q5=12.5; Q4=4.69; Q3=2.88; Q2=2.08; and Q1=1.63. The total of these flow rates is 23.78 bpm, which is slightly below the desired 25 bpm. The ratio of the desired flow rate to the determined flow rate is 25/23.78=1.05. The flow rate of each pump Q1-Q5 is therefore adjusted by this ratio to be Q5=13.14; Q4=4.93; Q3=3.03; Q2=2.19; and Q1=1.71. These adjusted flow rates total to 25 bpm, the desired flow rate, while maintaining a common transit time through the flow paths associated with each pump such that a step-change in the fluid entering the inlet 406 will emerge generally undegraded from the outlet 408.

To change the total flow delivered from the outlet 408 while maintaining the common transit time, the flow rates of all pumps Q1-Q5 may be adjusted by a common ratio. For example, to increase the total flow rate from 25 to 40 bpm (an increase of 60%), the individual flow rates of each pump Q1-Q5 may each be increased by 60% of the then present individual flow rate.

In the real world, the calculations are more complicated as the true volumes of each pipe segment must be determined and entered in the equations described above. In addition, the internal volumes of the pumps Q1-Q5 themselves as well as the volumes of any fittings, valves, and ports present in each pipe segment must be added to the calculated volume of each path.

Figure 6:
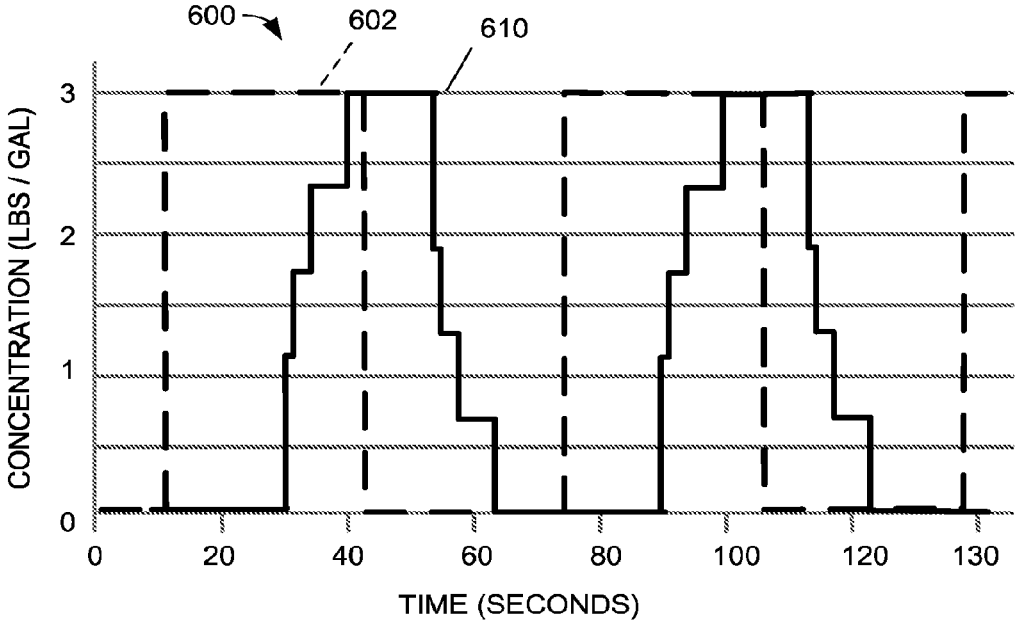
FIG. 6 is a plot of the delivered proppant concentration from the conventional manifold trailer of FIG. 4 for a first example step-change command profile.

FIG. 6 is a plot 600 of the delivered proppant concentration 610 from a simulation of the conventional manifold trailer 300 of FIG. 4. A command profile 602 representative of the proppant concentration of the flow entering the inlet 306 is depicted as changing from zero to 3 pounds per gallon (lbs/gal) in a first step change. The command profile 602 then holds at 3 lbs/gal for 30 seconds, then goes back to zero in a second step change and holds at zero for 30 seconds, and then repeats this cycle. It can be seen that the various transit times of the pumps Q1-Q5 manifest themselves in different arrival times of the step change at the outlet 308. In the example of FIG. 6, the change in proppant concentration 610 is spread over a time period of approximately 10 seconds in both the up and down directions.

Figure 7:
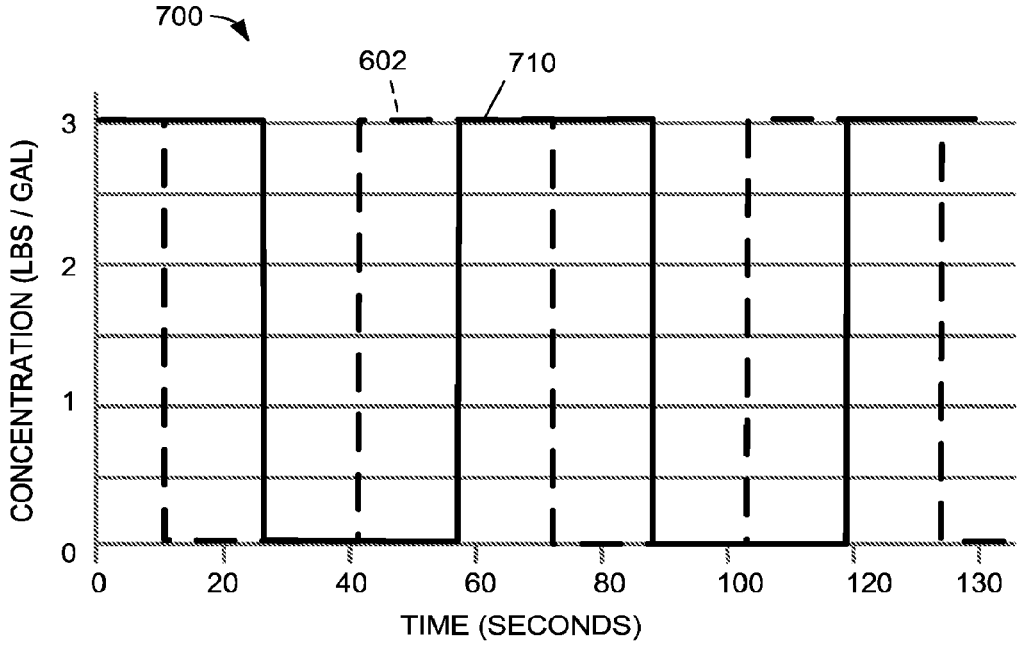
FIG. 7 is a plot of the delivered proppant concentration from the manifold and pump system of FIG. 5 for the step-change command profile of FIG. 6, according to one or more embodiments.

FIG. 7 is a plot 700 of the delivered proppant concentration 710 from a simulation of the exemplary manifold trailer 400 of FIG. 5 for the same step-change command profile 602 of FIG. 6, according to one or more embodiments. It can be seen that, as the transit times between the inlet 406 and the outlet 408 are the same for all pumps Q1-Q5, the delivered proppant concentration 710 shows substantially the same step-change as the command profile 602, only slightly offset in time.

Figure 8:
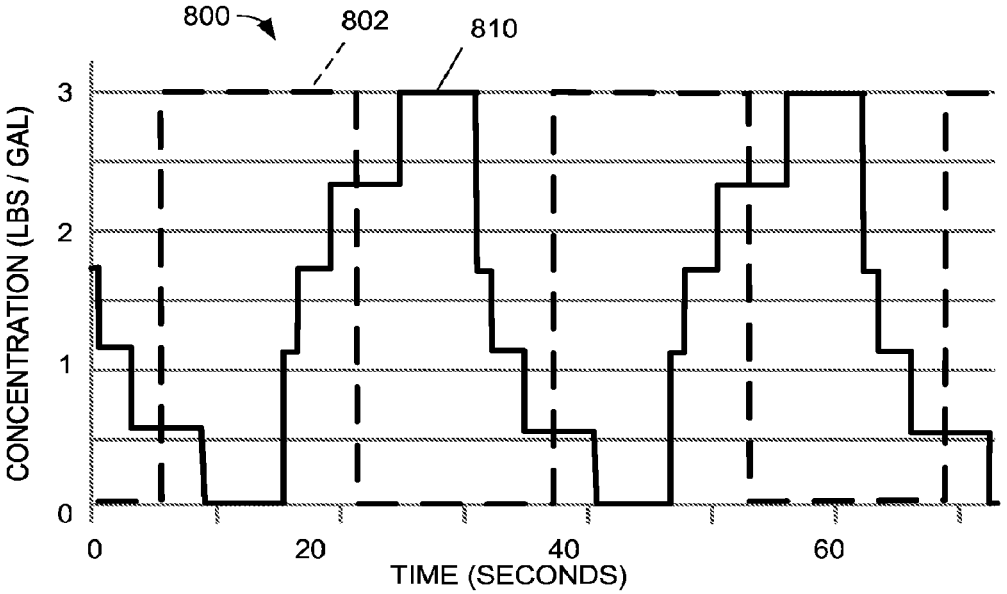
FIG. 8 is a second plot of the delivered proppant concentration from the conventional manifold and pump system of FIG. 4 for a second example step-change command profile.

FIG. 8 is a plot 800 of another delivered proppant concentration 810 from the conventional manifold trailer 300 of FIG. 4. In this example, a command profile 802 representative of the proppant concentration of the flow entering the inlet 306 is depicted as changing from zero to 3 pounds per gallon (lbs/gal) in a first step change. The command profile 802 then holds at 3 lbs/gal for 15 seconds, then goes back to zero in a second step change and holds at zero for 15 seconds, and then repeats this cycle. It can be seen that the effect of the different transit times increases as the duration of the command pulse is reduced. With a pulse length of 15 seconds and a diffusion of the step-change over a 10-second period, there is only a short time period of approximately 5 seconds where the proppant concentration in the proppant concentration 810 output is at the commanded level.

Figure 9:
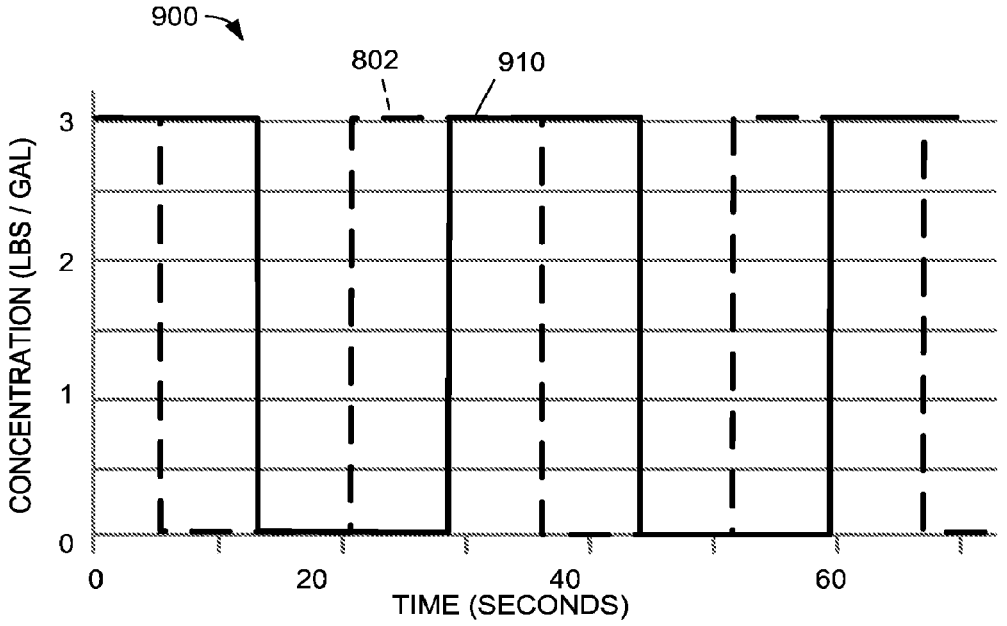
FIG. 9 is a second plot of the delivered proppant concentration from the manifold and pump system of FIG. 5 for the step-change command profile of FIG. 8, according to one or more embodiments.

FIG. 9 is a plot 900 of the delivered proppant concentration 910 from the manifold trailer 400 of FIG. 5 for the same step-change command profile 802 of FIG. 8, according to one or more embodiments. It can be seen that, despite the reduction in pulse width from 30 seconds to 15 seconds, the delivered proppant concentration 910 shows the same step-change as the command profile 802.

In summary, the disclosed manifold configuration and associated calculations allow the determination of individual pump speeds that collectively provide a transfer of a step-change from the input to the output without degradation of the step, and instead result in a more abrupt or sudden step-change in proppant concentration.

Embodiments disclosed herein include:

A. A method of providing a step-change in proppant concentration. The method may include selecting a first flow rate for a first pump connected between a first input node and first output node, calculating a first transit time for a flow of a fluid at the first flow rate through a first flow path extending from the first inlet node, through the first pump, and to the first outlet node, and calculating a second flow rate for a second pump connected between the first input node and the first output node such that a second transit time for a flow of the fluid through a second flow path extending from the first inlet node, through the second pump, and to the first outlet node is equal to the first transit time.

B. A multi-pump manifold that includes a first pump fluidly coupled between a first inlet node and a first outlet node, a first flow path extending from the first inlet node, through the first pump, and to the first outlet node, a second pump fluidly coupled between the first inlet node and the first outlet node, a second flow path extending from the first inlet node, through the second pump, and to the first outlet node that does not pass through any portion of the first flow path, a third pump fluidly coupled between a second inlet node and a second outlet node, a third flow path extending from the second inlet node, through the first inlet node, through the first pump, through the first outlet node, and to the second outlet node, and a fourth flow path extending from the second inlet node, through the third pump, and to the second outlet node that does not pass through any portion of the first, second, or third flow paths.

Each of embodiments A and B may have one or more of the following additional elements in any combination: Element 1: further comprising simultaneously operating the first and second pumps respectively at the first and second flow rates. Element 2: wherein calculating the first transit time comprises calculating a first fluid volume within the first flow path and dividing the first fluid volume by the first flow rate. Element 3: wherein calculating the second flow rate comprises calculating a second fluid volume within the second flow path and dividing the second fluid volume by the first transit time. Element 4: wherein the second flow path does not pass through any portion of the first flow path. Element 5: further comprising determining a calculated total flow rate by summing at least the first and second flow rates, determining a ratio of a desired total flow rate to the calculated total flow rate, and calculating first and second adjusted flow rates by respectively multiplying the first and second flow rates by the ratio. Element 6: further comprising simultaneously operating the first and second pumps respectively at the first and second adjusted flow rates. Element 7: further comprising pumping the fluid into a wellbore using the first and second pumps, wherein the fluid comprises a fracturing fluid. Element 8: further comprising calculating a third transit time for a flow of the fluid at the first flow rate through a third flow path extending from a second inlet node, through the first inlet node, through the first pump, through the first outlet node, and to a second outlet node, and calculating a third flow rate for a third pump connected between the second inlet node and the second outlet node such that a fourth transit time for a flow of fluid through a fourth flow path extending from the second inlet node, through the third pump, and to the second outlet node is equal to the first transit time. Element 9: wherein the fourth flow path does not pass through any portion of the first, second, or third flow paths. Element 10: further comprising simultaneously operating the first, second, and third pumps, respectively, at the first, second, and third flow rates. Element 11: further comprising pumping the fluid into a wellbore using the first, second, and third pumps, wherein the fluid comprises a fracturing fluid. Element 12: further comprising calculating a fifth transit time for a flow of the fluid at the first flow rate through a fifth flow path extending from a third inlet node, through the second inlet node, through the first inlet node, through the first pump, through the first outlet node, through the second outlet node, and to a third outlet node, and calculating a fourth flow rate for a fourth pump connected between the third inlet node and the third outlet node such that a sixth transit time for a flow of fluid through a sixth flow path extending from the third inlet node, through the fourth pump, and to the third outlet node is equal to the fifth transit time. Element 13: wherein the sixth flow path does not pass through any portion of the first, second, third, fourth, or fifth flow paths. Element 14: further comprising simultaneously operating the first, second, third, and fourth pumps, respectively, at the first, second, third, and fourth flow rates. Element 15: further comprising pumping the fluid into a wellbore using the first, second, third, and fourth pumps, wherein the fluid comprises a fracturing fluid.

Element 16: further comprising a manifold inlet having a flow path to the second inlet node that does not pass through any portion of the first, second, or third flow paths, and a manifold outlet having a flow path from the second outlet node that does not pass through any portion of the first, second, or third flow paths. Element 17: further comprising a source of a clean fluid, a source of a proppant slurry, and a blender fluidly coupled to the source of the clean fluid, the source of the proppant slurry, and the manifold inlet, the blender being configured to accept selected amounts of at least one of the clean fluid and the proppant slurry, mix the clean fluid and the proppant slurry to a generally uniform mixture, and deliver the mixture to the manifold inlet. Element 18: further comprising a controller coupled to the first, second, and third pumps, the controller being configured to accept a first nominal flow rate, a second nominal flow rate, and a third nominal flow rate, simultaneously operate the first pump at the first nominal flow rate, the second pump at the second nominal flow rate, and the third pump at the third nominal flow rate, accept a desired total flow rate, calculate a first adjusted flow rate, a second adjusted flow rate, and a third adjusted flow rate by respectively multiplying the first, second, and third nominal flow rates by a ratio of the desired total rate over a sum of at least the first, second, and third nominal flow rates, and simultaneously operate the first pump at the first adjusted flow rate, the second pump at the second adjusted flow rate, and the third pump at the third adjusted flow rate.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of providing a step-change in proppant concentration, the method comprising:

selecting a first flow rate for a first pump connected between a first inlet node and first outlet node;

calculating a first transit time for a flow of a fluid at the first flow rate through a first flow path extending from the first inlet node, through the first pump, and to the first outlet node; and calculating a second flow rate for a second pump connected between the first inlet node and the first outlet node such that a second transit time for a flow of the fluid through a second flow path extending from the first inlet node, through the second pump, and to the first outlet node is equal to the first transit time.

2. The method of claim 1, further comprising simultaneously operating the first and second pumps respectively at the first and second flow rates.

3. The method of claim 1, wherein calculating the first transit time comprises calculating a first fluid volume within the first flow path and dividing the first fluid volume by the first flow rate.

4. The method of claim 1, wherein calculating the second flow rate comprises calculating a second fluid volume within the second flow path and dividing the second fluid volume by the first transit time.

5. The method of claim 1, wherein the second flow path does not pass through any portion of the first flow path.

6. The method of claim 1, further comprising:

determining a calculated total flow rate by summing at least the first and second flow rates;

determining a ratio of a desired total flow rate to the calculated total flow rate; and calculating first and second adjusted flow rates by respectively multiplying the first and second flow rates by the ratio.

7. The method of claim 6, further comprising simultaneously operating the first and second pumps respectively at the first and second adjusted flow rates.

8. The method of claim 7, further comprising pumping the fluid into a wellbore using the first and second pumps, wherein the fluid comprises a fracturing fluid.

9. The method of claim 1, further comprising:

calculating a third transit time for a flow of the fluid at the first flow rate through a third flow path extending from a second inlet node, through the first inlet node, through the first pump, through the first outlet node, and to a second outlet node; and calculating a third flow rate for a third pump connected between the second inlet node and the second outlet node such that a fourth transit time for a flow of fluid through a fourth flow path extending from the second inlet node, through the third pump, and to the second outlet node is equal to the first transit time.

10. The method of claim 9, wherein the fourth flow path does not pass through any portion of the first, second, or third flow paths.

11. The method of claim 9, further comprising simultaneously operating the first, second, and third pumps, respectively, at the first, second, and third flow rates.

12. The method of claim 11, further comprising pumping the fluid into a wellbore using the first, second, and third pumps, wherein the fluid comprises a fracturing fluid.

13. The method of claim 9, further comprising:

calculating a fifth transit time for a flow of the fluid at the first flow rate through a fifth flow path extending from a third inlet node, through the second inlet node, through the first inlet node, through the first pump, through the first outlet node, through the second outlet node, and to a third outlet node; and calculating a fourth flow rate for a fourth pump connected between the third inlet node and the third outlet node such that a sixth transit time for a flow of fluid through a sixth flow path extending from the third inlet node, through the fourth pump, and to the third outlet node is equal to the fifth transit time.

14. The method of claim 13, wherein the sixth flow path does not pass through any portion of the first, second, third, fourth, or fifth flow paths.

15. The method of claim 13, further comprising simultaneously operating the first, second, third, and fourth pumps, respectively, at the first, second, third, and fourth flow rates.

16. The method of claim 15, further comprising pumping the fluid into a wellbore using the first, second, third, and fourth pumps, wherein the fluid comprises a fracturing fluid.

* * * * *